US008075711B2

(12) United States Patent
Nakagawa et al.

(10) Patent No.: US 8,075,711 B2
(45) Date of Patent: Dec. 13, 2011

(54) HOT-ROLLED HIGH STRENGTH STEEL SHEET HAVING EXCELLENT DUCTILITY, AND TENSILE FATIGUE PROPERTIES AND METHOD FOR PRODUCING THE SAME

(75) Inventors: Koichi Nakagawa, Kanagawa (JP); Reiko Sugihara, Chiba (JP); Tetsuo Shimizu, Chiba (JP); Shusaku Takagi, Hiroshima (JP)

(73) Assignee: JFE Steel Corporation, Tokyo (JP)

( * ) Notice: Subject to any disclaimer, the term of this patent is extended or adjusted under 35 U.S.C. 154(b) by 567 days.

(21) Appl. No.: 12/226,039

(22) PCT Filed: Dec. 27, 2006

(86) PCT No.: PCT/JP2006/326388

§ 371 (c)(1),
(2), (4) Date: Oct. 6, 2008

(87) PCT Pub. No.: WO2007/132548

PCT Pub. Date: Nov. 22, 2007

(65) Prior Publication Data

US 2009/0050244 A1 Feb. 26, 2009

(30) Foreign Application Priority Data

May 16, 2006 (JP) ..... 2006-136393

(51) Int. Cl.
*C21D 8/02* (2006.01)
*C21D 9/46* (2006.01)
*C22C 38/14* (2006.01)

(52) U.S. Cl. ..... 148/328; 148/601; 148/661; 420/126

(58) Field of Classification Search ..... 148/328, 148/601, 602, 661; 420/126
See application file for complete search history.

(56) References Cited

U.S. PATENT DOCUMENTS 7,527,700 B2 * 5/2009 Kariya et al. ..... 148/320

FOREIGN PATENT DOCUMENTS

| | | | | |
|---|---|---|---|---|
| JP | 07-062485 | A | | 3/1995 |
| JP | 08-199298 | A | | 8/1996 |
| JP | 11-241141 | A | | 9/1999 |
| JP | 2003-064442 | A | | 3/2003 |
| JP | 2003-321739 | A | | 11/2003 |
| JP | 2004-307919 | A | | 11/2004 |
| JP | 2004-339606 | A | | 12/2004 |
| JP | 2005-314796 | | * | 11/2005 |
| JP | 2005-314796 | A | | 11/2005 |
| JP | 2005-314798 | | * | 11/2005 |
| JP | 2005-314798 | A | | 11/2005 |
| JP | 2000-063360 | A | | 3/2006 |
| WO | WO 2004-094681 | A1 | * | 11/2004 |

* cited by examiner

*Primary Examiner* — George Wyszomierski
*Assistant Examiner* — Mark L Shevin
(74) *Attorney, Agent, or Firm* — Holtz, Holtz, Goodman & Chick, PC

(57) ABSTRACT

A hot-rolled high strength steel sheet in which, without using expensive Mo, and by effectively using Ti, which is an expensive element, the amount of precipitation hardening of which is large, both ductility and stretch-flangeability are improved at a tensile strength of 780 MPa or higher, and desirable tensile fatigue properties are exhibited. The hot-rolled high strength steel sheet has a composition including, in percent by mass, C: 0.06% to 0.15%, Si: 1.2% or less, Mn: 0.5% to 1.6%, P: 0.04% or less, S: 0.005% or less, Al: 0.05% or less, and Ti: 0.03% to 0.20%, the balance being Fe and incidental impurities, wherein the steel sheet has a structure in which the volume fraction of ferrite is 50% to 90%, the balance is substantially bainite, the total volume fraction of ferrite and bainite is 95% or more, precipitates containing Ti are precipitated in the ferrite, and the precipitates have an average diameter of 20 nm or less; and 80% or more of the Ti content in the steel is precipitated.

24 Claims, No Drawings

HOT-ROLLED HIGH STRENGTH STEEL SHEET HAVING EXCELLENT DUCTILITY, AND TENSILE FATIGUE PROPERTIES AND METHOD FOR PRODUCING THE SAME

This application is the U.S. national phase application of International Application
PCT/JP2006/326388 filed Dec. 7, 2006.

TECHNICAL FIELD

The present invention relates to a hot-rolled high strength steel sheet having excellent ductility, stretch-flangeability, and tensile fatigue properties and having a tensile strength (TS) of 780 MPa or higher, and a method for producing the same. It is intended to apply this high strength steel sheet to components, such as automobile and truck frames, which require formability and tensile fatigue properties.

BACKGROUND ART

Hot-rolled steel sheets with a tensile strength of 590 MPa or lower have been used for components, such as automobile and truck frames, which require formability and tensile fatigue properties because conventional 780 MPa grade steel is difficult to shape. Furthermore, the thickness of a 780 MPa grade steel sheet is, as a matter of course, smaller than that of a 590 MPa grade steel sheet. Consequently, the tensile fatigue properties of the conventional 780 MPa grade steel are insufficient when used for such components. However, in recent years, in order to improve the crashworthiness of automobiles, an increase in the strength of steel sheets for automobiles has been promoted, and use of 780 MPa grade steel for portions requiring tensile fatigue properties has come under study. The formability required for such components includes elongation and stretch-flangeability.

Examples of the method for improving elongation includes a technique using retained austenite, which is disclosed in Patent Document 1. However, retained austenite degrades stretch-flange formability. It is known that stretch-flangeability improves as the difference in hardness between the matrix and the other phases decreases. In retained austenite steel, the second phase is harder than the ferrite matrix and the difference in hardness between the second phase and the ferrite matrix is large. Thus, degradation in stretch-flange formability has been a problem. Meanwhile, in tempered martensite and bainitic single phase steel, stretch-flange formability is good because of a small difference in hardness between the matrix and the second phase, but ductility is low. Therefore, in order to achieve both ductility and stretch-flangeability, multiple phase steel is required in which the difference in hardness between the matrix and the second phase is small. Techniques regarding multiple phase steel sheets are disclosed in which the ferrite phase is precipitation-hardened by precipitates containing Ti, Mo, and W (Patent Document 2) and by precipitates containing Ti and Mo (Patent Document 3) so that the difference in hardness between the matrix and the bainite second phase is decreased. Furthermore, these patent documents are characterized by the fact that, while TiC can be easily coarsened by heat treatment, precipitates including Ti and Mo are inhibited from being coarsened. However, Mo is expensive compared with Ti, Nb, and V, which are carbide-forming elements, and moreover, in steel sheets which are produced by quenching followed by air cooling, or by holding followed by quenching, only about 50% or less of the Mo content in steel is precipitated, giving rise to a problem of cost increase.

Under these circumstances, there has been a demand for a technique which can increase the strength while satisfying the requirements for ductility and stretch-flangeability without using expensive Mo, but using a less expensive element, such as Ti.

Furthermore, Patent Document 4 discloses a technique on a steel sheet composed of phases of ferrite, which is precipitation-hardened by TiC, and bainite. According to an example in this patent document, at a sheet thickness of 2.9 mm, the tensile strength is 740 N/mm$^2$, the product (tensile strength)×(elongation) is 18,000 N/mm$^2$·% or more, and the product of hole expanding ratio and tensile strength, (tensile strength)×(hole expanding ratio), which is an index for stretch-flangeability, is 40,000 N/mm$^2$ or more. However, the tensile fatigue properties are not necessarily sufficient.

As a technique for improving fatigue properties, Patent Document 5 discloses a technique in which elongation and fatigue properties are improved by controlling the compositional fractions in a surface layer and an internal layer. However, this patent document does not mention any measures for improving stretch-flangeability.

Patent Document 1: Japanese Unexamined Patent Application Publication No. 7-62485

Patent Document 2: Japanese Unexamined Patent Application Publication No. 2003-321739

Patent Document 3: Japanese Unexamined Patent Application Publication No. 2004-339606

Patent Document 4: Japanese Unexamined Patent Application Publication No. 8-199298

Patent Document 5: Japanese Unexamined Patent Application Publication No. 11-241141

DISCLOSURE OF INVENTION

In view of the problems described above, it is an object of the present invention to provide a hot-rolled high strength steel sheet in which, without using expensive Mo, by effectively using carbide-forming elements, such as Ti, Nb, and V, in particular, Ti which is an inexpensive element and the amount of precipitation hardening of which is large, both ductility and stretch-flangeability are improved at a tensile strength of 780 MPa or higher, and excellent tensile fatigue properties are exhibited; and a method for producing the hot-rolled high strength steel sheet.

The target properties in the present invention are as described below.

(1) Tensile strength (TS)≧780 MPa (2) Ductility: elongation (EL)≧22%

(3) Stretch-flangeability: hole expanding ratio (λ)≧65%

(4) Tensile fatigue properties: endurance ratio in tensile fatigue [ratio of fatigue limit (FL) to TS (FL/TS)]≧0.65

The present invention advantageously solves the problems described above and is intended to propose a hot-rolled high strength steel sheet in which fine precipitates including Ti are formed and dispersed homogenously, thus effectively using precipitation hardening; both ductility and stretch-flangeability are achieved in high strength steel with a TS of 780 MPa or higher; and furthermore, tensile fatigue properties are improved, as well as an advantageous production method therefor.

Conventionally, it has been believed that, when Ti is used alone, since Ti is easily coarsened, precipitates must be refined in the presence of Mo. The present inventors have studied in detail the precipitation of Ti and, as a result, have found that by starting rapid cooling immediately after hot rolling and by controlling the cooling conditions, it is possible to form fine precipitates containing Ti in ferrite.

That is, as a result of diligent studies, the present inventors have found that when the composition system shown in item [1] or [2] is used, the volume fraction of ferrite is set in the range of 50% to 90%, the balance being bainite, precipitates containing Ti, with an average diameter of 20 nm or less, are finely precipitated in the ferrite, and 80% or more of the Ti content in the steel is precipitated, the elongation and stretch-flangeability have very high values, and furthermore, the tensile fatigue properties improve dramatically. In order to achieve this structure, it has been found that it is important to use the steel having the composition shown in item [1] or [2] below and to control the time from final rolling in a hot rolling process to the start of cooling.

The reason for this is believed to be that by controlling the time from the end of rolling to the start of cooling to be short, and by cooling to a temperature that is 680° C. or higher and lower than ($Ar_3$ point minus 20° C.), it becomes possible to prevent strain introduced by rolling from being recovered and to maximize the strain as a driving force for the ferrite transformation, furthermore, it becomes possible that fine precipitates including Ti are formed in the ferrite, which has been considered to be difficult, and also precipitation can be effectively performed.

That is, the gist of the present invention is as described below.

[1] A hot-rolled high strength steel sheet having excellent ductility, stretch-flangeability, and tensile fatigue properties with a tensile strength of 780 MPa or higher, the steel sheet having a composition including, in percent by mass,
C: 0.06% to 0.15%,
Si: 1.2% or less,
Mn: 0.5% to 1.6%,
P: 0.04% or less,
S: 0.005% or less,
Al: 0.05% or less, and
Ti: 0.03% to 0.20%,
the balance being Fe and incidental impurities,
wherein the steel sheet has a structure in which the volume fraction of ferrite is 50% to 90%, the balance is substantially bainite, the total volume fraction of ferrite and bainite is 95% or more, precipitates containing Ti are precipitated in the ferrite, and the precipitates have an average diameter of 20 nm or less; and 80% or more of the Ti content in the steel is precipitated.

[2] A hot-rolled high strength steel sheet having excellent ductility, stretch-flangeability, and tensile fatigue properties with a tensile strength of 780 MPa or higher, the steel sheet having a composition including, in percent by mass,
C: 0.06% to 0.15%,
Si: 1.2% or less,
Mn: 0.5% to 1.6%,
P: 0.04% or less,
S: 0.005% or less,
Al: 0.05% or less, and
Ti: 0.03% to 0.20%,
and further including at least one or two of Nb: 0.005% to 0.10% and V: 0.03% to 0.15%, the balance being Fe and incidental impurities,
wherein the steel sheet has a structure in which the volume fraction of ferrite is 50% to 90%, the balance is substantially bainite, the total volume fraction of ferrite and bainite is 95% or more, precipitates containing Ti are precipitated in the ferrite, and the precipitates have an average diameter of 20 nm or less; and 80% or more of the Ti content in the steel is precipitated.

[3] The hot-rolled high strength steel sheet having excellent ductility, stretch-flangeability, and tensile fatigue properties with a tensile strength of 780 MPa or higher according to item [1] or [2], wherein under the assumption that each individual bainite grain has a shape of ellipse, the average longer axis length of bainite grains is less than 10 μm.

[4] The hot-rolled high strength steel sheet having excellent ductility, stretch-flangeability, and tensile fatigue properties with a tensile strength of 780 MPa or higher according to item [1] or [2], wherein under the assumption that each individual bainite grain has a shape of ellipse, the average longer axis length of bainite grains is 10 μm or more, and the average aspect ratio of ellipses corresponding to the bainite grains is 4.5 or less.

[5] The hot-rolled high strength steel sheet having excellent ductility, stretch-flangeability, and tensile fatigue properties with a tensile strength of 780 MPa or higher according to any one of items [1] to [4], wherein the average hardness ($Hv_\alpha$) of the ferrite and the average hardness ($Hv_B$) of the bainite satisfy the relationship $$Hv_B - Hv_\alpha \leqq 230.$$

[6] A method for producing a hot-rolled high strength steel sheet having excellent ductility, stretch-flangeability, and tensile fatigue properties with a tensile strength of 780 MPa or higher, the method including heating a steel slab to 1,150° C. to 1,300° C., the steel slab having a composition including, in percent by mass,
C: 0.06% to 0.15%,
Si: 1.2% or less,
Mn: 0.5% to 1.6%,
P: 0.04% or less,
S: 0.005% or less,
Al: 0.05% or less, and
Ti: 0.03% to 0.20%,
the balance being Fe and incidental impurities; then performing hot rolling at a final rolling temperature that is $Ar_3$ point or higher and lower than ($Ar_3$ point plus 100° C.); starting cooling within 3.0 s thereafter; performing accelerated cooling at an average cooling rate of 30° C./s or higher to a cooling stop temperature that is 680° C. or higher and lower than ($Ar_3$ point minus 20° C.); performing air cooling for 3 to 15 s without performing accelerated cooling; then performing accelerated cooling at an average cooling rate of 20° C./s or higher; and performing winding at 300° C. to 600° C.

[7] A method for producing a hot-rolled high strength steel sheet having excellent ductility, stretch-flangeability, and tensile fatigue properties with a tensile strength of 780 MPa or higher, the method including heating a steel slab to 1,150° C. to 1,300° C., the steel slab having a composition including, in percent by mass,
C: 0.06% to 0.15%,
Si: 1.2% or less,
Mn: 0.5% to 1.6%,
P: 0.04% or less,
S: 0.005% or less,
Al: 0.05% or less, and
Ti: 0.03% to 0.20%,
and further including at least one or two of Nb: 0.005% to 0.10% and V: 0.03% to 0.15%, the balance being Fe and incidental impurities; then performing hot rolling at a final rolling temperature that is $Ar_3$ point or higher and lower than ($Ar_3$ point plus 100° C.); starting cooling within 3.0 s thereafter; performing accelerated cooling at an average cooling rate of 30° C./s or higher to a cooling stop temperature that is 680° C. or higher and lower than ($Ar_3$ point minus 20° C.); performing air cooling for 3 to 15 s without performing accelerated cooling; then performing accelerated cooling at an average cooling rate of 20° C./s or higher; and performing winding at 300° C. to 600° C.

[8] The method for producing a hot-rolled high strength steel sheet having excellent ductility, stretch-flangeability, and tensile fatigue properties with a tensile strength of 780 MPa or higher according to Item [6] or [7], wherein the final rolling temperature is $Ar_3$ point or higher and lower than ($Ar_3$ point plus 50° C.).

[9] The method for producing a hot-rolled high strength steel sheet having excellent ductility, stretch-flangeability, and tensile fatigue properties with a tensile strength of 780 MPa or higher according to Item [6] or [7], wherein the final rolling temperature is ($Ar_3$ point plus 50° C.) or higher and lower than ($Ar_3$ point plus 80° C.).

[10] The method for producing a hot-rolled high strength steel sheet having excellent ductility, stretch-flangeability, and tensile fatigue properties with a tensile strength of 780 MPa or higher according to any one of items [6] to [9], wherein the winding temperature is 350° C. to 500° C.

According to the present invention, by producing Ti-added steel so as to have a structure including ferrite+bainite and by forming and dispersing homogenously fine precipitates including Ti in the ferrite, it is possible to obtain excellent ductility, stretch-flangeability, and tensile fatigue properties at a high tensile strength of 780 MPa or higher, and as a result, it is possible to decrease the sheet thickness of automobile and truck components, thus greatly contributing to higher performance in automobile bodies.

BEST MODES FOR CARRYING OUT THE INVENTION

The present invention will be specifically described below.

First, in the present invention, the reasons for limitations of the compositions of steel sheets or steel slabs to the ranges described above will be described. Note that "%" for the composition means percent by mass unless otherwise specified.

C: 0.06% to 0.15%

C is an element necessary for precipitating carbides as precipitates in ferrite and generating bainite. For that purpose, the C content is required to be 0.06% or more. However, if the content exceeds 0.15%, weldability degrades. Therefore, the upper limit is set at 0.15%. The C content is more preferably in the range of 0.07% to 0.12%.

Si: 1.2% or less

Si has a function of accelerating the ferrite transformation. Si also functions as a solid-solution strengthening element. The Si content is preferably 0.1% or more. However, if Si is contained in a large amount exceeding 1.2%, surface properties degrade significantly and corrosion resistance also degrades. Therefore, the upper limit is set at 1.2%. The Si content is more preferably in the range of 0.2% to 1.0%.

Mn: 0.5% to 1.6%

Mn is added in order to increase the strength. However, if the Mn content is less than 0.5%, the effect of addition thereof is insufficient. If the Mn content is excessively large exceeding 1.6%, weldability degrades significantly. Therefore, the upper limit is set at 1.6%. The Mn content is more preferably in the range of 0.8% to 1.2%.

P: 0.04% or less

P tends to be segregated in the old y grain boundaries, thus degrading low-temperature toughness, and also tends to be segregated in steel. Consequently, P increases the anisotropy of steel sheets and degrades workability. Therefore, the P content is preferably decreased as much as possible. However, since the P content up to 0.04% is permissible, the upper limit is set at 0.04%. The P content is more preferably 0.03% or less.

S: 0.005% or less

When S is segregated in the old y grain boundaries or a large amount of MnS is generated, low-temperature toughness is degraded, resulting in difficulty in use in cold climates, and also stretch-flangeability is degraded significantly. Therefore, the S content is preferably decreased as much as possible. However, since the S content up to 0.005% is permissible, the upper limit is set at 0.005%.

Al: 0.05% or less

Al is added as a deoxidizer for steel and is an element effective in improving the cleanliness of steel. In order to obtain this effect, it is preferable to set the Al content at 0.001% or more. However, if the Al content exceeds 0.05%, a large amount of inclusions is generated, which may cause occurrence of scars in steel sheets. Therefore, the upper limit is set at 0.05%.

Ti: 0.03% to 0.20%

Ti is a very important element in view of precipitation-hardening ferrite. If the Ti content is less than 0.03%, it is difficult to ensure necessary strength. If the Ti content exceeds 0.20%, the effect thereof is saturated, which only leads to an increase in cost. Therefore, the upper limit is set at 0.20%. The Ti content is more preferably in the range of 0.08% to 0.18%.

The basic constituents have been described above. In the present invention, the elements described below may also be incorporated.

Nb: 0.005% to 0.10%

V: 0.03% to 0.15%

In order to impart strength and fatigue strength, at least one or two of Nb and V may be incorporated. These elements function as a precipitation hardening element or a solid-solution strengthening element, and contribute to improvement of strength and fatigue strength. However, if the Nb content is less than 0.005% or the V content is less than 0.03%, the effect of addition thereof is insufficient. If the Nb content exceeds 0.10% or the V content exceeds 0.15%, the effect thereof is saturated, which only leads to an increase in cost. Therefore, the upper limit is set at 0.10% for Nb and 0.15% for V. More preferably, the Nb content is in the range of 0.02% to 0.06%, and the V content is in the range of 0.05% to 0.10%.

The reasons for limitations of the structure of steel sheets will now be described below.

Volume fraction of ferrite: 50% to 90%

If the volume fraction of ferrite is less than 50%, the volume fraction of the hard second phase becomes excessive, and stretch-flangeability degrades. Therefore, the volume fraction of ferrite must be set at 50% or more. On the other hand, if the volume fraction of ferrite exceeds 90%, the volume fraction of the second phase becomes excessively small, and elongation does not improve. Therefore, the volume fraction of ferrite must be set at 90% or less. The volume fraction of ferrite is more preferably in the range of 65% to 88%.

The balance in the steel structure being substantially bainite, and the total volume fraction of ferrite and bainite being 95% or more In order to obtain good stretch-flangeability, the balance, other than ferrite, in the steel structure must be substantially bainite.

Here, the balance, other than ferrite, in the steel structure being substantially bainite means that the balance, other than ferrite, in the steel structure is mainly composed of bainite, and the structure is formed so that the total volume fraction of ferrite and bainite is 95% or more. Although there may be a case where a phase other than ferrite and bainite, such as martensite, may be mixed, the other phase is permissible if the fraction of the other phase is 5% or less. In such a case, the balance can be considered to be substantially bainite. More preferably, the total volume fraction of ferrite and bainite is more than 97%.

Precipitates containing Ti being precipitated in the ferrite, and the precipitates having an average diameter of 20 nm or less The precipitates containing Ti are effective in strengthening ferrite and improving tensile fatigue strength. Furthermore, in the present invention, such precipitates containing Ti are believed to be mainly precipitated as carbides in the ferrite. The hardness of the soft ferrite is increased by precipitation hardening of the precipitates, such as carbides, and the difference in hardness between the soft ferrite and the hard bainite is decreased, thus being effective in improving stretch-flangeability. Moreover, if the average diameter of the precipitates containing Ti precipitated in the ferrite exceeds 20 nm, the effect of preventing dislocations from moving is small, and it is not possible to obtain required strength and tensile fatigue strength. Therefore, it is necessary to set the average diameter of the precipitates containing Ti precipitated in the ferrite at 20 nm or less.

80% or more of the Ti content in the steel being precipitated

When only less than 80% of the Ti content in the steel is precipitated, Ti that has not formed precipitates together with C, etc. remains in the solid solution state in the ferrite. In such a case, the action of improving the strength and tensile fatigue strength is small, thus being uneconomical and inefficient. According to the present invention, it has been found that, in order to achieve the required strength and fatigue strength economically and efficiently, it is effective that 80% or more of the Ti content in the steel is precipitated. Furthermore, more preferably, the average diameter of the precipitates is in the range of 3 to 15 nm. More preferably, 90% or more of the Ti content in the steel is precipitated.

In the present invention, the precipitates containing Ti are precipitated mainly in the ferrite as described above. The reason for this is believed to be that the solid solubility limit of C in ferrite is smaller than that in austenite, and supersaturated C tends to be precipitated by forming carbides containing Ti in the ferrite. Actually, when a thin film sample prepared from the steel sheet was observed with a transmission electron microscope (TEM), the precipitates were recognized in the ferrite.

Average longer axis length of bainite grains being less than 10 μm under the assumption that each individual bainite grain has a shape of ellipse The shape of bainite influences the stretch-flangeability, and the smaller gain size of bainite is more preferable in view of obtaining better stretch-flangeability. Specifically, preferably, the average longer axis length of bainite grains is less than 10 μm.

Average longer axis length of bainite grains being 10 μm or more and average aspect ratio of ellipses corresponding to the bainite grains being 4.5 or less under the assumption that each individual bainite grain has a shape of ellipse In the case where the average longer axis length of bainite grains is 10 μm or more, the bainite grains preferably approximate to equiaxed grains as much as possible in view of obtaining good stretch-flangeability. Specifically, preferably, the average aspect ratio (longer axis length/shorter axis length) of ellipses corresponding to the bainite grains is 4.5 or less. In this case, in view of improving stretch-flangeability, the average longer axis length of bainite grains is preferably 50 μm or less.

The reason for the fact that the stretch-flangeability is further improved by decreasing the grain size (longer axis length) of bainite or by decreasing the aspect ratio so that the bainite grains approximate to equiaxed grains as much as possible is believed to be that, at a blanked end face, an increase in initial cracks can be prevented during blanking, and the expansion of cracks can be delayed during flange forming.

Average hardness ($Hv_\alpha$) of ferrite phase and average hardness ($Hv_B$) of bainite phase satisfying the relationship $$Hv_B - Hv_\alpha \leqq 230$$

By decreasing the difference between the average hardness ($Hv_B$) of the bainite phase and the average hardness ($Hv_\alpha$) of the ferrite phase, ($Hv_B - Hv_\alpha$), as much as possible, specifically, to 230 or less, it is possible to decrease the difference in deformation between the ferrite phase and the bainite phase when the steel sheet is subjected to working. Therefore, an increase in cracks can be prevented, and better stretch-flangeability can be obtained.

A production method of the present invention will now be described.

Heating steel slab to 1,150° C. to 1,300° C.

In the steel slab, Ti, or Nb and V in addition to Ti, are mostly present as carbides. In order to form precipitates as desired in the ferrite after hot rolling, the precipitates precipitated as carbides before hot rolling must be melted. For that purpose, it is required to perform heating to a temperature higher than 1,150° C. If heating is performed at a temperature higher than 1,300° C., the crystal grain size becomes excessively coarse, and both elongation and stretch-flangeability degrade. Therefore, heating is performed at 1,300° C. or lower. Preferably, heating is performed at 1,200° C. or higher.

Final rolling temperature in hot rolling: $Ar_3$ point or higher and equal to or lower than ($Ar_3$ point plus 100° C.)

After the steel slab is heated to the heating temperature described above, hot rolling is performed, and the final rolling temperature, which is the hot rolling end temperature, is set at $Ar_3$ point or higher and equal to or lower than ($Ar_3$ point plus 100° C.). If the final rolling temperature is lower than $Ar_3$ point, rolling is performed in the state of ferrite+austenite. In such a case, since an elongated ferrite structure is formed, stretch-flangeability degrades. Under the condition where the final rolling temperature exceeds ($Ar_3$ point plus 100° C.), strain introduced by rolling is recovered, and consequently, the required amount of ferrite cannot be obtained. Therefore, final rolling is performed at the final rolling temperature that is $Ar_3$ point or higher and equal to or lower than ($Ar_3$ point plus 100° C.).

Furthermore, if the final rolling is performed, at a final rolling temperature that is ($Ar_3$ point plus 50° C.) or higher and lower than ($Ar_3$ point plus 80° C.), the aspect ratio becomes 4.5 or less in the case where the length of the longer axis of bainite grains is 10 μm or more, and the stretch-flangeability improves.

Furthermore, in order to set the average longer axis length of bainite grains to be less than 10 μm, in the production method described above, the final rolling temperature is preferably set at $Ar_3$ point or higher and lower than ($Ar_3$ point plus 50° C.).

Starting cooling within 3.0 s after final rolling and performing accelerated cooling at an average cooling rate of 30° C./s or higher to a cooling stop temperature that is 680° C. or higher and lower than ($Ar_3$ point minus 20° C.)

If the period of time after final hot rolling until the start of accelerated cooling exceeds 3.0 s, strain introduced by rolling is recovered. Consequently, it is not possible to obtain the required amount of ferrite, amount of precipitates containing Ti, and grain size. More preferably, cooling is started within 1.6 s.

If the cooling stop temperature is ($Ar_3$ point minus 20° C.) or higher, the nucleation of ferrite does not easily occur. Consequently, it is not possible to obtain the required amount of ferrite, amount of precipitates containing Ti, and grain size. If the cooling stop temperature is lower than 680° C., the diffusion rate of C and Ti decreases. Consequently, it is not possible to obtain the required amount of ferrite, amount of precipitates containing Ti, and grain size. More preferably, accelerated cooling is performed at a cooling stop temperature that is 720° C. or higher and lower than ($Ar_3$ point minus 30° C.).

In the accelerated cooling after the hot rolling, the average cooling rate from the final rolling temperature to the cooling stop temperature must be 30° C./s or higher. If the cooling rate is lower than 30° C./s, pearlite is generated, resulting in degradation of properties. Preferably, the cooling rate is 70° C./s or higher. Although the upper limit of the cooling rate is not particularly specified, in order to accurately stop the cooling within the cooling stop temperature range described above, the cooling rate is preferably about 300° C./s.

Performing air cooling for 3 to 15 s without performing accelerated cooling

After the accelerated cooling is stopped, air cooling is performed for 3 to 15 s without performing accelerated cooling. If the period of time in which accelerated cooling is stopped, i.e., air cooling period, is less than 3 s, it is not possible to obtain the required amount of ferrite. If the air cooling period exceeds 15 s, pearlite is generated, resulting in degradation of properties. Furthermore, the cooling rate is about 15° C./s during the period in which accelerated cooling is stopped and air cooling is performed.

After the air cooling, performing accelerated cooling at an average cooling rate of 20° C./s or higher, and performing winding at 300° C. to 600° C.

After the air cooling, accelerated cooling is started, in which cooling is performed at an average cooling rate of 20° C./s or higher to the winding temperature, and winding is performed at 300° C. to 600° C. That is, the winding temperature is set at 300° C. to 600° C. If the winding temperature is lower than 300° C., quenching occurs, and the rest of the structure becomes martensite, resulting in degradation in stretch-flangeability. If the winding temperature exceeds 600° C., pearlite is generated, resulting in degradation of properties. Furthermore, if the winding temperature is set at 350° C. to 500° C., the difference between the average hardness ($Hv_B$) of the bainite phase and the average hardness ($Hv_\alpha$) of the ferrite phase, ($Hv_B-Hv_\alpha$), satisfies the relationship $Hv_B-Hv_\alpha \leqq 230$. Thus, the stretch-flangeability can be improved. Therefore, the winding temperature is preferably set at 350° C. to 500° C. Furthermore, when the cooling rate in the accelerated cooling after air cooling is lower than 20° C./s, pearlite is generated, resulting in degradation of properties. Therefore, the average cooling rate is set at 20° C./s or higher after air cooling until winding. Although the upper limit of the cooling rate is not particularly limited, in order to accurately stop the cooling within the winding temperature range described above, the cooling rate is preferably set at about 300° C./s.

EXAMPLES

Example 1

Each of the steels having the compositions shown in Table 1 was melted in a converter, and a steel slab was formed by continuous casting. The steel slab was subjected to hot rolling, cooling, and winding under the conditions shown in Table 2. Thereby, a hot-rolled steel sheet with a thickness of 2.0 mm was obtained. Note that $Ar_3$ shown in Table 2 is the value obtained from the formula $Ar_3=910-203\times\sqrt{C}+44.7\times Si-30\times Mn$ (where C, Si, and Mn represent the contents of the respective elements in percent by mass), which is a regression formula for calculating $Ar_3$.

With respect to the steel sheets thus obtained, the microstructure, tensile properties, stretch-flangeability, and tensile fatigue properties were investigated.

The tensile properties were tested by a method according to JISZ2241 using JIS No. 5 test pieces in which the tensile direction was set to be parallel to the rolling direction. The hole expansion test was carried out according to the Japan Iron and Steel Federation standard JFST 1001.

The ferrite and bainite fractions were obtained as described below. With respect to a cross section parallel to the rolling direction, the structure was revealed by a 3% nital solution, the cross section at the position corresponding to a quarter of the sheet thickness was observed by an optical microscope with a magnifying power of 400, and the area ratios of the ferrite and bainite portions were quantified by image processing and defined as volume fractions of ferrite and bainite.

The longer axis length of bainite grains and the aspect ratio were obtained as described below. With respect to a cross section parallel to the rolling direction, the structure was revealed by a 3% nital solution, and the cross section at the position corresponding to a quarter of the sheet thickness was observed by an optical microscope with a magnifying power of 400. Image analysis processing was performed using Image-Pro PLUS ver. 4.0.0.11 (manufactured by Media Cybernetics Corp.), in which ellipses (ellipses corresponding to characteristic objects) having the same areas as those of the individual bainite grains observed and having the same moments of inertia as those of the individual bainite grains were assumed, and the longer axis length and the shorter axis length were obtained for each of the ellipses. The aspect ratio was defined as longer axis length/shorter axis length. The longer axis lengths and the aspect ratios obtained for the individual bainite grains were averaged, and thereby, the average longer axis length and the average aspect ratio for the bainite grains were obtained.

In order to observe the precipitates, the structure of the ferrite was observed by a transmission electron microscope (TEM) with a magnifying power of 200,000 or higher. The compositions of the precipitates, such as Ti, Nb, and V, were identified by analysis with an energy-dispersive X-ray analyzer (EDX) mounted on the TEM. With respect to the precipitates containing Ti, image processing was performed using Image-Pro PLUS in the same manner as described above, in which the diameters passing through the center of gravity of each of the precipitates (objects) to be measured were measured at 2 degree intervals, and the measured values were averaged to obtain the diameter of each of the precipitates. The diameters of the individual precipitates were averaged, and thereby, the average diameter of the precipitates containing Ti was obtained.

The tensile fatigue test was carried out under the condition of a stress ratio R of 0.05, the fatigue limit (FL) was obtained at a number of repeats of $10^7$, and the endurance ratio (FL/TS) was calculated. Note that the stress ratio R is a value defined by (minimum repeated load)/(maximum repeated load).

The amount of precipitates containing Ti was calculated as the ratio of the amount of precipitated Ti to the Ti content in steel. The amount of precipitated Ti can be obtained by extractive analysis. In an extractive analysis method, the residue electrolytically extracted using a maleic acid-based electrolyte solution is subjected to alkali fusion, the resulting melt is dissolved in an acid, and then measurement is performed by ICP emission spectrometry.

The hardness of ferrite and bainite were measured as described below. A tester conforming to JISB7725 was used for a Vickers hardness test. With respect to a cross section parallel to the rolling direction, the structure was revealed by a 3% nital solution. In the cross section, at the position corresponding to a quarter of the sheet thickness, ferrite grains and bainite grains were indented with a testing force of 0.0294 N (test load of 3 g). The hardness was calculated from the diagonal length of the indentation using the formula for calculating Vickers hardness according to JISZ2244. With respect to 30 grains each for ferrite and bainite, the hardness was measured, and the measured values were averaged. The average values for the ferrite grains and the bainite grains were defined as the average hardness ($Hv_{\alpha}$) of the ferrite phase and the average hardness ($Hv_{B}$) of the bainite phase.

The results are shown in Table 3. In the examples of the present invention, at a sheet thickness of 2.0 mm and a tensile strength of 780 MPa or higher, the elongation was 22% or more, the hole expanding ratio was 65% or more, and the endurance ratio (FL/TS) in the tensile fatigue test was 0.65 or more.

As described above, in a hot-rolled high strength steel sheet having excellent ductility, stretch-flangeability, and tensile fatigue properties according to the present invention, by adjusting the composition and the production conditions, by allowing the steel sheet to have a structure composed of ferrite and bainite, and by forming and dispersing homogenously the fine precipitates including Ti, it is possible to achieve a tensile strength of 780 MPa or higher, an elongation of 22% or more, a hole expanding ratio of 65% or more, and an endurance ratio in tensile fatigue of or more at a sheet thickness of 2.0 mm, and it is possible to decrease the sheet thickness of automobile components and to improve the crashworthiness of automobiles, thus greatly contributing to higher performance in automobile bodies, which is an excellent effect.

TABLE 1

| Steel | Composition (mass %) | | | | | | | | | |
|---|---|---|---|---|---|---|---|---|---|---|
| type | C | Si | Mn | P | S | Al | Ti | Nb | V | Remarks |
| A | 0.101 | 0.91 | 1.46 | 0.018 | 0.0028 | 0.022 | 0.119 | 0.048 | — | Suitable steel |
| B | 0.181 | 0.59 | 1.01 | 0.021 | 0.0011 | 0.031 | 0.100 | — | — | Comparative steel |
| C | 0.113 | 0.72 | 0.52 | 0.026 | 0.0014 | 0.036 | 0.118 | 0.079 | — | Suitable steel |
| D | 0.096 | 0.78 | 0.64 | 0.018 | 0.0018 | 0.039 | 0.087 | — | 0.080 | Suitable steel |
| E | 0.092 | 0.64 | 0.93 | 0.021 | 0.0010 | 0.025 | 0.097 | 0.023 | — | Suitable steel |
| F | 0.142 | 0.67 | 0.60 | 0.011 | 0.0010 | 0.032 | 0.093 | — | 0.067 | Suitable steel |
| G | 0.092 | 0.65 | 0.60 | 0.011 | 0.0035 | 0.035 | 0.020 | — | — | Comparative steel |
| H | 0.109 | 0.10 | 0.56 | 0.024 | 0.0010 | 0.028 | 0.117 | — | 0.120 | Suitable steel |
| I | 0.110 | 0.29 | 0.87 | 0.039 | 0.0015 | 0.042 | 0.152 | — | — | Suitable steel |
| J | 0.072 | 0.54 | 0.78 | 0.003 | 0.0035 | 0.031 | 0.121 | 0.120 | — | Comparative steel |
| K | 0.130 | 0.72 | 1.10 | 0.012 | 0.0020 | 0.032 | 0.090 | — | 0.180 | Comparative steel |
| L | 0.098 | 0.61 | 0.71 | 0.011 | 0.0035 | 0.028 | 0.179 | — | — | Suitable steel |
| M | 0.063 | 0.05 | 0.76 | 0.012 | 0.0021 | 0.035 | 0.089 | — | 0.052 | Suitable steel |
| N | 0.095 | 0.58 | 0.95 | 0.020 | 0.0011 | 0.015 | 0.182 | — | — | Suitable steel |
| O | 0.127 | 1.08 | 0.89 | 0.030 | 0.0042 | 0.031 | 0.121 | 0.025 | 0.083 | Suitable steel |
| P | 0.072 | 0.53 | 1.21 | 0.016 | 0.0008 | 0.031 | 0.138 | 0.006 | 0.072 | Suitable steel |
| Q | 0.101 | 0.91 | 1.50 | 0.018 | 0.0028 | 0.022 | 0.119 | 0.048 | — | Suitable steel |
| R | 0.041 | 0.52 | 1.46 | 0.032 | 0.0016 | 0.034 | 0.106 | — | — | Comparative steel |
| S | 0.103 | 0.63 | 0.85 | 0.019 | 0.0015 | 0.031 | 0.090 | — | — | Suitable steel |
| T | 0.110 | 0.65 | 0.80 | 0.020 | 0.0015 | 0.030 | 0.090 | 0.006 | 0.100 | Suitable steel |

TABLE 2

| No | Steel type | Slab heating temperature (° C.) | $Ar_3$ (° C.) | $Ar_3$ + 100 (° C.) | Final rolling temperature (° C.) | Cooling* start time (s) | First-stage** cooling rate (° C./s) | $Ar_3$ − 20 (° C.) | First-stage cooling stop temperature (° C.) | Air cooling time (s) | Second-stage*** cooling rate (° C./s) | Winding temperature (° C.) | Remarks |
|---|---|---|---|---|---|---|---|---|---|---|---|---|---|
| 1 | A | 1258 | 842 | 942 | 923 | 2.5 | 89 | 822 | 768 | 3 | 28 | 537 | EP |
| 2 | A | 1248 | 842 | 942 | 903 | 5.2 | 53 | 822 | 810 | 6 | 54 | 465 | CE |
| 3 | B | 1220 | 820 | 920 | 908 | 3.0 | 45 | 800 | 782 | 4 | 34 | 326 | CE |
| 4 | C | 1226 | 858 | 958 | 930 | 0.6 | 35 | 838 | 708 | 5 | 35 | 412 | EP |
| 5 | D | 1286 | 863 | 963 | 921 | 2.0 | 35 | 843 | 815 | 5 | 38 | 514 | EP |
| 6 | D | 1280 | 863 | 963 | 882 | 2.4 | 72 | 843 | 653 | 7 | 48 | 428 | CE |
| 7 | E | 1281 | 849 | 949 | 872 | 2.6 | 112 | 829 | 793 | 6 | 32 | 356 | EP |
| 8 | F | 1152 | 845 | 945 | 920 | 2.9 | 58 | 825 | 741 | 13 | 62 | 402 | EP |
| 9 | F | 1230 | 845 | 945 | 915 | 3.0 | 55 | 825 | 730 | 10 | 15 | 395 | CE |
| 10 | G | 1212 | 859 | 959 | 898 | 2.5 | 63 | 839 | 728 | 5 | 34 | 375 | CE |
| 11 | H | 1240 | 831 | 931 | 910 | 0.7 | 45 | 811 | 720 | 7 | 45 | 620 | CE |
| 12 | H | 1239 | 831 | 931 | 905 | 0.9 | 42 | 811 | 712 | 6 | 42 | 391 | EP |
| 13 | I | 1186 | 830 | 930 | 895 | 1.2 | 32 | 810 | 795 | 5 | 52 | 406 | EP |
| 14 | I | 1250 | 830 | 930 | 912 | 1.6 | 35 | 810 | 821 | 7 | 38 | 438 | CE |
| 15 | J | 1163 | 856 | 956 | 896 | 1.1 | 73 | 836 | 695 | 6 | 37 | 449 | CE |
| 16 | K | 1254 | 836 | 936 | 869 | 1.5 | 125 | 816 | 784 | 6 | 36 | 435 | CE |
| 17 | L | 1273 | 852 | 952 | 895 | 1.3 | 52 | 832 | 776 | 7 | 23 | 526 | EP |
| 18 | M | 1268 | 838 | 938 | 880 | 1.3 | 48 | 818 | 764 | 7 | 48 | 457 | EP |
| 19 | M | 1263 | 838 | 938 | 856 | 2.3 | 78 | 818 | 695 | 2 | 36 | 356 | CE |

TABLE 2-continued

| No | Steel type | Slab heating temperature (° C.) | $Ar_3$ (° C.) | $Ar_3$ + 100 (° C.) | Final rolling temperature (° C.) | Cooling* start time (s) | First-stage** cooling rate (° C./s) | $Ar_3$ − 20 (° C.) | First-stage cooling stop temperature (° C.) | Air cooling time (s) | Second-stage*** cooling rate (° C./s) | Winding temperature (° C.) | Remarks |
|---|---|---|---|---|---|---|---|---|---|---|---|---|---|
| 20 | M | 1252 | 838 | 938 | 843 | 2.6 | 80 | 818 | 701 | 3 | 40 | 246 | CE |
| 21 | N | 1275 | 845 | 945 | 852 | 0.7 | 38 | 825 | 736 | 7 | 35 | 468 | EP |
| 22 | O | 1243 | 859 | 959 | 864 | 0.9 | 76 | 839 | 795 | 6 | 34 | 492 | EP |
| 23 | P | 1238 | 843 | 943 | 882 | 1.8 | 129 | 823 | 725 | 9 | 26 | 427 | EP |
| 24 | Q | 1280 | 841 | 941 | 898 | 1.3 | 35 | 821 | 721 | 16 | 40 | 490 | CE |
| 25 | Q | 1291 | 841 | 941 | 891 | 1.5 | 31 | 821 | 712 | 5 | 39 | 483 | EP |
| 26 | R | 1225 | 848 | 948 | 869 | 2.7 | 79 | 828 | 823 | 7 | 29 | 455 | CE |
| 27 | S | 1235 | 848 | 948 | 935 | 1.0 | 34 | 828 | 725 | 5 | 54 | 512 | EP |
| 28 | S | 1235 | 848 | 948 | 912 | 1.0 | 34 | 828 | 725 | 5 | 54 | 456 | EP |
| 29 | S | 1235 | 848 | 948 | 875 | 1.0 | 34 | 828 | 725 | 5 | 54 | 480 | EP |
| 30 | T | 1235 | 848 | 948 | 933 | 1.0 | 34 | 828 | 725 | 5 | 54 | 515 | EP |
| 31 | T | 1235 | 848 | 948 | 915 | 1.0 | 34 | 828 | 725 | 5 | 54 | 450 | EP |
| 32 | T | 1235 | 848 | 948 | 874 | 1.0 | 34 | 828 | 725 | 5 | 54 | 495 | EP |

*Period of time from the end of final rolling until the start of cooling

**Average cooling rate from the final rolling temperature to the first-stage cooing stop temperature

***Average cooling rate from the temperature immediately after air cooling to the winding temperature EP: Example of Present Invention CE: Comparative Example

TABLE 3

| No | Steel type | Tensile strength (MPa) | Elongation (%) | Hole expanding ratio (%) | Tensile fatigue limit (MPa) | Endurance ratio | Ferrite fraction (%) | Ferrite + bainite fraction (%) | Average longer axis length of bainite (μm) |
|---|---|---|---|---|---|---|---|---|---|
| 1 | A | 812 | 24 | 72 | 585 | 0.72 | 72 | 97 | 35 |
| 2 | A | 752 | 20 | 43 | 391 | 0.52 | 48 | 100 | 18 |
| 3 | B | 832 | 21 | 23 | 483 | 0.58 | 42 | 100 | 30 |
| 4 | C | 856 | 22 | 73 | 693 | 0.81 | 68 | 100 | 25 |
| 5 | D | 832 | 23 | 78 | 682 | 0.82 | 75 | 100 | 12 |
| 6 | D | 763 | 19 | 42 | 481 | 0.63 | 45 | 99 | 25 |
| 7 | E | 846 | 22 | 81 | 685 | 0.81 | 80 | 98 | 9 |
| 8 | F | 821 | 24 | 74 | 616 | 0.75 | 71 | 100 | 32 |
| 9 | F | 815 | 13 | 35 | 424 | 0.52 | 75 | 80 | 31 |
| 10 | G | 729 | 24 | 68 | 467 | 0.64 | 73 | 100 | 8 |
| 11 | H | 822 | 13 | 42 | 477 | 0.58 | 73 | 87 | 13 |
| 12 | H | 815 | 25 | 80 | 619 | 0.76 | 68 | 100 | 19 |
| 13 | I | 863 | 22 | 68 | 621 | 0.72 | 85 | 100 | 20 |
| 14 | I | 743 | 20 | 54 | 446 | 0.60 | 38 | 100 | 41 |
| 15 | J | 924 | 15 | 21 | 573 | 0.62 | 86 | 100 | 21 |
| 16 | K | 967 | 13 | 29 | 590 | 0.61 | 81 | 100 | 9 |
| 17 | L | 845 | 22 | 73 | 676 | 0.80 | 76 | 100 | 9 |
| 18 | M | 832 | 25 | 81 | 657 | 0.79 | 79 | 96 | 8 |
| 19 | M | 815 | 21 | 46 | 481 | 0.59 | 35 | 98 | 45 |
| 20 | M | 1001 | 14 | 27 | 601 | 0.60 | 88 | 89 | 9 |
| 21 | N | 851 | 23 | 67 | 570 | 0.67 | 84 | 96 | 7 |
| 22 | O | 796 | 25 | 89 | 541 | 0.68 | 86 | 98 | 7 |
| 23 | P | 801 | 23 | 85 | 665 | 0.83 | 85 | 99 | 8 |
| 24 | Q | 820 | 14 | 40 | 410 | 0.50 | 80 | 90 | 6 |
| 25 | Q | 824 | 23 | 78 | 659 | 0.80 | 76 | 96 | 11 |
| 26 | R | 758 | 23 | 67 | 379 | 0.50 | 89 | 92 | 15 |
| 27 | S | 830 | 23 | 75 | 656 | 0.79 | 73 | 100 | 40 |
| 28 | S | 828 | 23 | 88 | 662 | 0.8 | 82 | 100 | 18 |
| 29 | S | 825 | 24 | 110 | 660 | 0.80 | 86 | 100 | 8 |
| 30 | T | 840 | 22 | 72 | 700 | 0.83 | 76 | 100 | 43 |
| 31 | T | 845 | 22 | 89 | 693 | 0.82 | 83 | 100 | 20 |
| 32 | T | 838 | 22 | 99 | 679 | 0.81 | 88 | 100 | 9 |

| No | Average aspect ratio* | HvB − Hvα | Average diameter of precipitates containing Ti (nm) | Amount of precipitation** (%) | TS × EL | TS × λ | Remarks |
|---|---|---|---|---|---|---|---|
| 1 | 5.2 | 350 | 15 | 84 | 19488 | 58464 | EP |
| 2 | 4.5 | 198 | 40 | 53 | 15040 | 32336 | CE |
| 3 | 4.8 | 260 | 19 | 81 | 17472 | 19136 | CE |
| 4 | 3.8 | 220 | 3 | 96 | 18832 | 62488 | EP |
| 5 | 4.2 | 250 | 12 | 86 | 19136 | 64896 | EP |

TABLE 3-continued

| | | | | | | | |
|---|---|---|---|---|---|---|---|
| 6 | 2.5 | 86 | 30 | 63 | 14497 | 32046 | CE |
| 7 | 4.8 | 153 | 12 | 83 | 18612 | 68526 | EP |
| 8 | 4.1 | 168 | 10 | 82 | 19704 | 60754 | EP |
| 9 | 3 | 361 | 19 | 81 | 10595 | 28525 | CE |
| 10 | 3.2 | 250 | 31 | 83 | 17496 | 49572 | CE |
| 11 | 3.6 | 255 | 11 | 82 | 10686 | 34524 | CE |
| 12 | 4.2 | 147 | 14 | 94 | 20375 | 65200 | EP |
| 13 | 4.3 | 190 | 6 | 92 | 18986 | 58684 | EP |
| 14 | 4.8 | 271 | 31 | 62 | 14860 | 40122 | CE |
| 15 | 3.5 | 160 | 15 | 82 | 13860 | 19404 | CE |
| 16 | 4.6 | 120 | 23 | 83 | 12571 | 28043 | CE |
| 17 | 5.0 | 420 | 9 | 95 | 18590 | 61685 | EP |
| 18 | 5.2 | 156 | 11 | 91 | 20800 | 67392 | EP |
| 19 | 5 | 320 | 17 | 72 | 17115 | 37490 | CE |
| 20 | 4.2 | 325 | 18 | 87 | 14014 | 27027 | CE |
| 21 | 4.8 | 210 | 8 | 95 | 19573 | 57017 | EP |
| 22 | 5.3 | 53 | 7 | 86 | 19900 | 70844 | EP |
| 23 | 5.5 | 98 | 8 | 95 | 18423 | 68085 | EP |
| 24 | 5.1 | 340 | 15 | 80 | 11480 | 32800 | CE |
| 25 | 4.2 | 120 | 6 | 90 | 18952 | 64272 | EP |
| 26 | 3.7 | 350 | 12 | 82 | 17434 | 50786 | CE |
| 27 | 5.0 | 300 | 5 | 93 | 19090 | 62250 | EP |
| 28 | 2.0 | 110 | 5 | 93 | 19044 | 72864 | EP |
| 29 | 2.0 | 132 | 5 | 94 | 19800 | 90750 | EP |
| 30 | 5.1 | 320 | 5 | 92 | 18480 | 60480 | EP |
| 31 | 2 | 113 | 5 | 93 | 18590 | 75205 | EP |
| 32 | 8 | 142 | 5 | 95 | 18436 | 82962 | EP |

*Average of (longer axis length/shorter axis length) of ellipses corresponding to bainite grains
**Precipitation percentage of Ti contained in the steel
EP: Example of Present Invention
CE: Comparative Example

The invention claimed is:

1. A hot-rolled high strength steel sheet having ductility, stretch-flangeability, and tensile fatigue properties with a tensile strength of 780 MPa or higher, the steel sheet having a composition consisting of, in percent by mass, C: 0.06% to 0.15%,
Si: 1.2% or less,
Mn: 0.5% to 1.6%,
P: 0.04% or less,
S: 0.005% or less,
Al: 0.05% or less, and
Ti: 0.03% to 0.20%,
the balance being Fe and incidental impurities, wherein the steel sheet has a structure in which the volume fraction of ferrite is 50% to 90%, the balance is substantially bainite, the total volume fraction of ferrite and bainite is 95% or more, precipitates containing Ti are precipitated in the ferrite, and the precipitates have an average diameter of 20 nm or less; and 80% or more of the Ti content in the steel is precipitated.

2. The hot-rolled high strength steel sheet having ductility, stretch-flangeability, and tensile fatigue properties with a tensile strength of 780 MPa or higher according to claim 1, wherein under the assumption that each individual bainite grain has a shape of an ellipse, the average longer axis length of bainite grains is less than 10 μm.

3. The hot-rolled high strength steel sheet having ductility, stretch-flangeability, and tensile fatigue properties with a tensile strength of 780 MPa or higher according to claim 1, wherein under the assumption that each individual bainite grain has a shape of an ellipse, the average longer axis length of bainite grains is 10 μm or more, and the average aspect ratio of ellipses corresponding to the bainite grains is 4.5 or less.

4. The hot-rolled high strength steel sheet having ductility, stretch-flangeability, and tensile fatigue properties with a tensile strength of 780 MPa or higher according to claim 1, wherein the average hardness ($Hv_\alpha$) of the ferrite and the average hardness ($Hv_B$) of the bainite satisfy the following relationship: $Hv_B - Hv_\alpha \leqq 230$.

5. The hot-rolled high strength steel sheet having ductility, stretch-flangeability, and tensile fatigue properties with a tensile strength of 780 MPa or higher according to claim 2, wherein the average hardness ($Hv_\alpha$) of the ferrite and the average hardness ($Hv_B$) of the bainite satisfy the following relationship: $Hv_B - Hv_\alpha \leqq 230$.

6. The hot-rolled high strength steel sheet having ductility, stretch-flangeability, and tensile fatigue properties with a tensile strength of 780 MPa or higher according to claim 3, wherein the average hardness ($Hv_\alpha$) of the ferrite and the average hardness ($Hv_B$) of the bainite satisfy the following relationship: $Hv_B - Hv_\alpha \leqq 230$.

7. A hot-rolled high strength steel sheet having ductility, stretch-flangeability, and tensile fatigue properties with a tensile strength of 780 MPa or higher, the steel sheet having a composition consisting of, in percent by mass, C: 0.06% to 0.15%,
Si: 1.2% or less,
Mn: 0.5% to 1.6%,
P: 0.04% or less,
S: 0.005% or less,
Al: 0.05% or less, and
Ti: 0.03% to 0.20%,
and at least one or two of Nb: 0.005% to 0.10% and V: 0.03% to 0.15%, the balance being Fe and incidental impurities, wherein the steel sheet has a structure in which the volume fraction of ferrite is 50% to 90%, the balance is substantially bainite, the total volume fraction of ferrite and bainite is 95% or more, precipitates containing Ti are precipitated in the ferrite, and the precipitates have an average diameter of 20 nm or less; and 80% or more of the Ti content in the steel is precipitated.

8. The hot-rolled high strength steel sheet having ductility, stretch-flangeability, and tensile fatigue properties with a tensile strength of 780 MPa or higher according to claim 7, wherein under the assumption that each individual bainite grain has a shape of an ellipse, the average longer axis length of bainite grains is less than 10 μm.

9. The hot-rolled high strength steel sheet having ductility, stretch-flangeability, and tensile fatigue properties with a tensile strength of 780 MPa or higher according to claim 7, wherein under the assumption that each individual bainite grain has a shape of an ellipse, the average longer axis length of bainite grains is 10 μm or more, and the average aspect ratio of ellipses corresponding to the bainite grains is 4.5 or less.

10. The hot-rolled high strength steel sheet having ductility, stretch-flangeability, and tensile fatigue properties with a tensile strength of 780 MPa or higher according to claim 7, wherein the average hardness ($Hv_\alpha$) of the ferrite and the average hardness ($Hv_B$) of the bainite satisfy the following relationship: $Hv_B - Hv_\alpha \leqq 230$.

11. The hot-rolled high strength steel sheet having ductility, stretch-flangeability, and tensile fatigue properties with a tensile strength of 780 MPa or higher according to claim 8, wherein the average hardness ($Hv_\alpha$) of the ferrite and the average hardness ($Hv_B$) of the bainite satisfy the following relationship: $Hv_B - Hv_\alpha \leqq 230$.

12. The hot-rolled high strength steel sheet having ductility, stretch-flangeability, and tensile fatigue properties with a tensile strength of 780 MPa or higher according to claim 9, wherein the average hardness ($Hv_\alpha$) of the ferrite and the average hardness ($Hv_B$) of the bainite satisfy the following relationship: $Hv_B - Hv_\alpha \leqq 230$.

13. A method for producing the hot-rolled high strength steel sheet of claim 1 , the method comprising heating a steel slab to 1,150° C. to 1,300° C., the steel slab having a composition consisting of, in percent by mass, C: 0.06% to 0.15%,
Si: 1.2% or less,
Mn: 0.5% to 1.6%,
P: 0.04% or less,
S: 0.005% or less,
Al: 0.05% or less, and
Ti: 0.03% to 0.20%, the balance being Fe and incidental impurities; then performing hot rolling at a final rolling temperature that is $Ar_3$ point or higher and lower than ($Ar_3$ point plus 100° C.); starting cooling within 3.0 s thereafter; performing accelerated cooling at an average cooling rate of 30° C/s or higher to a cooling stop temperature that is 680° C. or higher and lower than ($Ar_3$ point minus 20° C.); performing air cooling for 3 to 15 s without performing accelerated cooling; then performing accelerated cooling at an average cooling rate of 20° C/s or higher; and performing winding at 300° C. to 600° C.

14. The method for producing a hot-rolled high strength steel sheet having ductility, stretch-flangeability, and tensile fatigue properties with a tensile strength of 780 MPa or higher according to claim 13, wherein the final rolling temperature is $Ar_3$ point or higher and lower than ($Ar_3$ point plus 50° C.).

15. The method for producing a hot-rolled high strength steel sheet having ductility, stretch-flangeability, and tensile fatigue properties with a tensile strength of 780 MPa or higher according to claim 13, wherein the final rolling temperature is ($Ar_3$ point, plus 50° C.) or higher and lower than ($Ar_3$ point plus 80° C.).

16. The method for producing a hot-rolled high strength steel sheet having ductility, stretch-flangeability, and tensile fatigue properties with a tensile strength of 780 MPa or higher according to claim. 13, wherein the winding temperature is 350° C. to 500° C.

17. The method for producing a hot-rolled high strength steel sheet having ductility, stretch-flangeability, and tensile fatigue properties with a tensile strength of 780 MPa or higher according to claim 14, wherein the winding temperature is 350° C. to 500° C.

18. The method for producing a hot-rolled high strength steel sheet having ductility, stretch-flangeability, and tensile fatigue properties with a tensile strength of 780 MPa or higher according to claim 15, wherein the winding temperature is 350° C. to 500° C.

19. A method for producing the hot-rolled high strength steel sheet of claim 2, the method comprising heating a steel slab to 1,150° C. to 1,300° C., the steel slab having a composition consisting of, in percent by mass, C: 0.06% to 0.15%, Si: 1.2% or less,
Mn: 0.5% to 1.6%,
P: 0.04% or less,
S: 0.005% or less,
Al: 0.05% or less, and
Ti: 0.03% to 0.20%, and at least one or two of Nb: 0.005% to 0.10% and V: 0.03% to 0.15%, the balance being Fe and incidental impurities; then performing hot rolling at a final rolling temperature that is $Ar_3$ point or higher and lower than ($Ar_3$ point plus 100° C.); starting cooling within 3.0 s thereafter; performing accelerated cooling at an average cooling rate of 30° C/s or higher to a cooling stop temperature that is 680° C. or higher and lower than ($Ar_3$ point minus 20° C.); performing air cooling for 3 to 15 s without performing accelerated cooling; then performing accelerated cooling at an average cooling rate of 20° C/s or higher; and performing winding at 300° C. to 600° C.

20. The method for producing a hot-rolled high strength steel sheet having ductility, stretch-flangeability, and tensile fatigue properties with a tensile strength of 780 MPa or higher according to claim 19, wherein the final rolling temperature is $Ar_3$ point or higher and lower than ($Ar_3$ point plus 50° C.).

21. The method for producing a hot-rolled high strength steel sheet having ductility, stretch-flangeability, and tensile fatigue properties with a tensile strength of 780 MPa or higher according to claim 19, wherein the final rolling temperature is ($Ar_3$ point plus 50° C.) or higher and lower than ($Ar_3$ point plus 80° C.).

22. The method for producing a hot-rolled high strength steel sheet having ductility, stretch-flangeability, and tensile fatigue properties with a tensile strength of 780 MPa or higher according to claim 19, wherein the winding temperature is 350° C. to 500° C.

23. The method for producing a hot-rolled high strength steel sheet having ductility, stretch-flangeability, and tensile fatigue properties with a tensile strength of 780 MPa or higher according to claim 20, wherein the winding temperature is 350° C. to 500° C.

24. The method for producing a hot-rolled high strength steel sheet having ductility, stretch-flangeability, and tensile fatigue properties with a tensile strength of 780 MPa or higher according to claim 21, wherein the winding temperature is 350° C. to 500° C.

* * * * *